United States Patent [19]

Laval, Jr.

[11] 3,947,364

[45] Mar. 30, 1976

[54] APPARATUS FOR REMOVING PARTICLES FROM FLUID

[76] Inventor: Claude C. Laval, Jr., 2444 N. Farris, Fresno, Calif. 93705

[22] Filed: June 13, 1974

[21] Appl. No.: 479,030

[52] U.S. Cl. ..... 210/512 R; 210/84

[51] Int. Cl.[2] ..... B04C 5/103; B04C 5/04

[58] Field of Search ..... 55/52, 203, 204, 457; 209/144, 211; 210/84, 136, 304, 311, 512 R, 512 M

[56] References Cited

UNITED STATES PATENTS

| | | | |
|---|---|---|---|
| 680,717 | 8/1901 | Labadie | 55/457 X |
| 684,829 | 10/1901 | Labadie | 55/457 X |
| 2,465,021 | 3/1949 | Kennison et al. | 210/512 R X |
| 3,024,908 | 3/1962 | Ibing et al. | 209/144 |
| 3,105,044 | 9/1963 | Troland | 209/211 X |
| 3,232,430 | 2/1966 | Saint-Jacques | 209/144 |
| 3,288,286 | 11/1966 | Prins et al. | 209/144 X |
| 3,481,118 | 12/1969 | Willis et al. | 210/512 R X |
| 3,512,651 | 5/1970 | Laval, Jr. | 210/512 R |

FOREIGN PATENTS OR APPLICATIONS

| | | | |
|---|---|---|---|
| 794,789 | 5/1968 | United Kingdom | 209/144 |

*Primary Examiner*—Charles N. Hart
*Assistant Examiner*—Robert H. Spitzer
*Attorney, Agent, or Firm*—Huebner & Worrel

[57] ABSTRACT

An apparatus for removing particles from fluid providing a casing having a first chamber with an inlet for particle laden fluid disposed in substantially tangential relation to the first chamber to produce a fluid vortex therewithin, a second chamber with individual particle and fluid outlets, and a partition disposed within the casing intermediate the chambers to form an annular passage interconnecting the chambers in fluid transferring relation for annular constriction of the fluid vortex centrifically to separate particles from the fluid for segregated discharge through their respective particle and fluid outlets.

3 Claims, 9 Drawing Figures

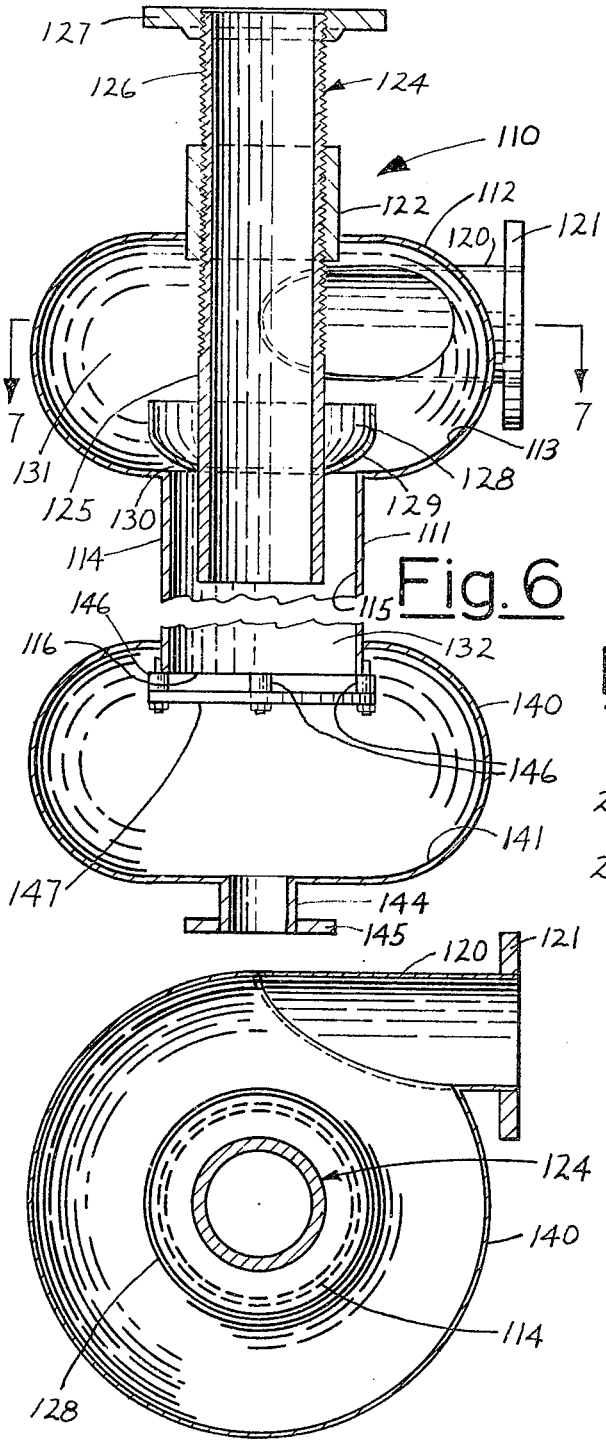
Fig. 6
Fig. 7
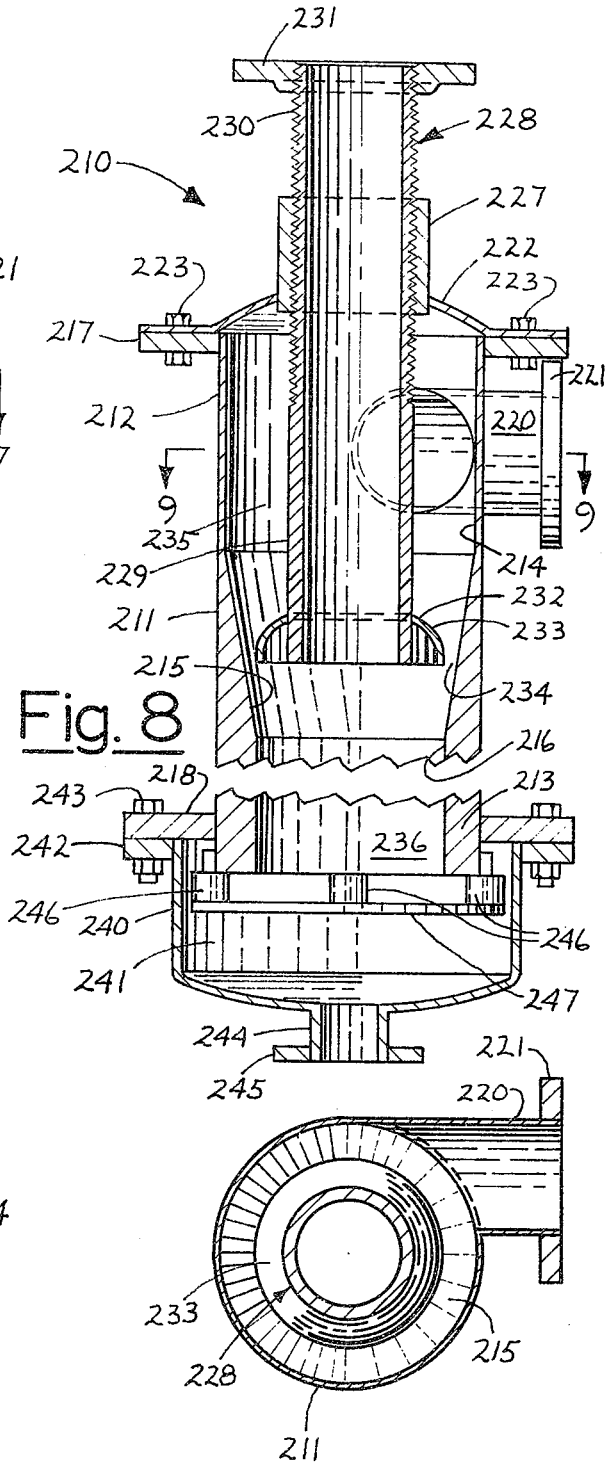
Fig. 8
Fig. 9

APPARATUS FOR REMOVING PARTICLES FROM FLUID

BACKGROUND OF THE INVENTION

The present invention relates to an apparatus for removing particles from fluid and more particularly to a cyclonic apparatus which maximizes the amount of particulate matter which can be removed from a carrier fluid while minimizing the amount of internal wear, which operates at a normal internal pressure significantly below that of conventional separating devices while producing little or no pressure drop in fluid transmitted therethrough, which can be manufactured at a cost far below that heretofore possible with prior art separating devices, and which can be produced in a form permitting ready adjustment for control of the size and quantity of particulate matter removed from a given carrier fluid.

Cyclonic or vortexing separators have long been popular for the separation of particulate matter from carrier fluids. Those invented by the applicant and comprising the subject matter of U.S. Pat. Nos. 3,289,608; 3,512,651; 3,568,837; and 3,701,425 are in many respects typical of successful cyclonic separators. Other separators of interest are those of the Bishop U.S. Pat. No. 2,943,698; the Fowle et al. U.S. Pat. No. 3,237,767; the Brown et al. U.S. Pat. No. 3,237,777; the Stavenger U.S. Pat. No. 3,259,246; the Feasel U.S. Pat. No. 3,499,531; the Maciula et al. U.S. Pat. No. 3,529,724; the Fournier U.S. Pat. No. 3,750,885; the Troland U.S. Pat. No. 3,754,655; the Maciula et al. U.S. Pat. No. 3,776,385; and the Maciula U.S. Pat. No. 3,784,009. However, the technology embodied in such prior art devices is imperfect in several important respects, to which reference will subsequently be made. It will also become evident that the apparatus of the present invention has achieved significant technological advances in dealing with certain deficiencies of the prior art.

As evidenced by the above patents, the prior art is replete with a variety of cyclonic separating devices. All of the devices with which the applicant is familiar, however, employ an internal configuration which includes a cone structure and/or a sleeve having a plurality of tangentially disposed fluid openings. Such internal structures are employed to produce a centrifuging fluid vortex in fluid transmitted therethrough which operates to separate particulate matter from the carrier fluid. These internal structures suffer from the common deficiency of producing a significant fluid pressure drop in fluid transmitted therethrough.

In the case of separating devices employing an internal cone structure, the fluid vortex is commonly directed into the cone in helically converging relation to increase the speed of fluid flow and thereby the centrifuging action to remove particulate matter. Such devices commonly suffer from several important deficiencies. First, the cost of such devices is greater than desired due to the difficulty in manufacturing such a conical structure. Second, such devices are expensive to maintain in that the convergence of the side walls of the cone, produces quite rapid wearing of the internal surfaces of the cone structure as a result of the abrading action of the particulate matter centrifically thrown thereagainst. This requires frequent repair or replacement of the cone structure. Third, such devices frequently produce extremely high internal pressures as a result of this centrifuging action which makes compliance with the highest safety code standards for high pressure devices difficult.

Separating devices which utilize a sleeve having a plurality of tangential fluid inlets are subject to other imperfections which detract from their operational attributes. In the case of this type of separating device, the plurality of tangential inlet openings are bounded by edges which are subject to abrasion by particulate matter passing with the fluid therethrough. This abrasion cause relatively rapid wearing of the edges which necessitates that such edges be coated with a protective surface at relatively frequent intervals or simply that the sleeve be replaced at such intervals. This is, of course, costly and detracts from the overall utility of the devices in that considerable down time is required for such maintenance. Furthermore, the manufacture of a sleeve with a plurality of tangential openings involves considerable expense.

Therefore, it has long been recognized that it would be desirable to have an apparatus for removing particles from fluid which operates efficiently to remove particulate matter from a carrier fluid while producing little or no pressure drop in fluid transmitted therethrough and which can be manufactured at a cost heretofore unattainable in prior art cyclonic separating devices while at the same time providing an apparatus which requires little or no maintenance of the type required by conventional such separators.

SUMMARY OF THE INVENTION

Accordingly, it is an object of the present invention to provide an improved apparatus for removing particles from fluid.

Another object is to provide such an apparatus which is highly efficient in removing particulate matter from a carrier fluid.

Another object is to provide such an apparatus which can be constructed entirely from readily available standardized component parts and assembled at minimum manufacturing cost.

Another object is to provide such an apparatus which produces little or no pressure drop in fluid transmitted therethrough.

Another object is to provide such an apparatus which minimizes the difficulties attendant to internal wear due to abrasion by particulate matter transmitted therethrough.

Another object is to provide such an apparatus which alleviates the necessity for frequent maintenance as a result of internal wear.

Another object is to provide such a cyclonic apparatus which avoids the use of an internal cone structure.

Another object is to provide such an apparatus which operates at a relatively low internal fluid pressure thereby facilitating compliance with even the highest safety code standards.

Another object is to provide such an apparatus which avoids the use of a sleeve having a plurality of tangential openings.

A further object is to provide such an apparatus which can be produced in a form which is readily adjustable to vary the size, density, and quantity of particulate matter which can be separated from a given carrier fluid by the device without disassembly of the entire apparatus.

Further objects and advantages are to provide improved elements and arrangements thereof in an apparatus for the purposes described which is dependable, economical, durable and fully effective in accomplishing its intended purposes.

BRIEF DESCRIPTION OF THE DRAWINGS

FIG. 6 is a foreshortened axial section of a second embodiment of the invention.

FIG. 7 is a transverse section taken at a position indicated by line 7—7 in FIG. 6.

FIG. 8 is a foreshortened axial section of a third embodiment of the invention.

FIG. 9 is a transverse section taken at a position indicated by line 9—9 in FIG. 8.

DESCRIPTION OF THE FIRST EMBODIMENT

Figure 1:
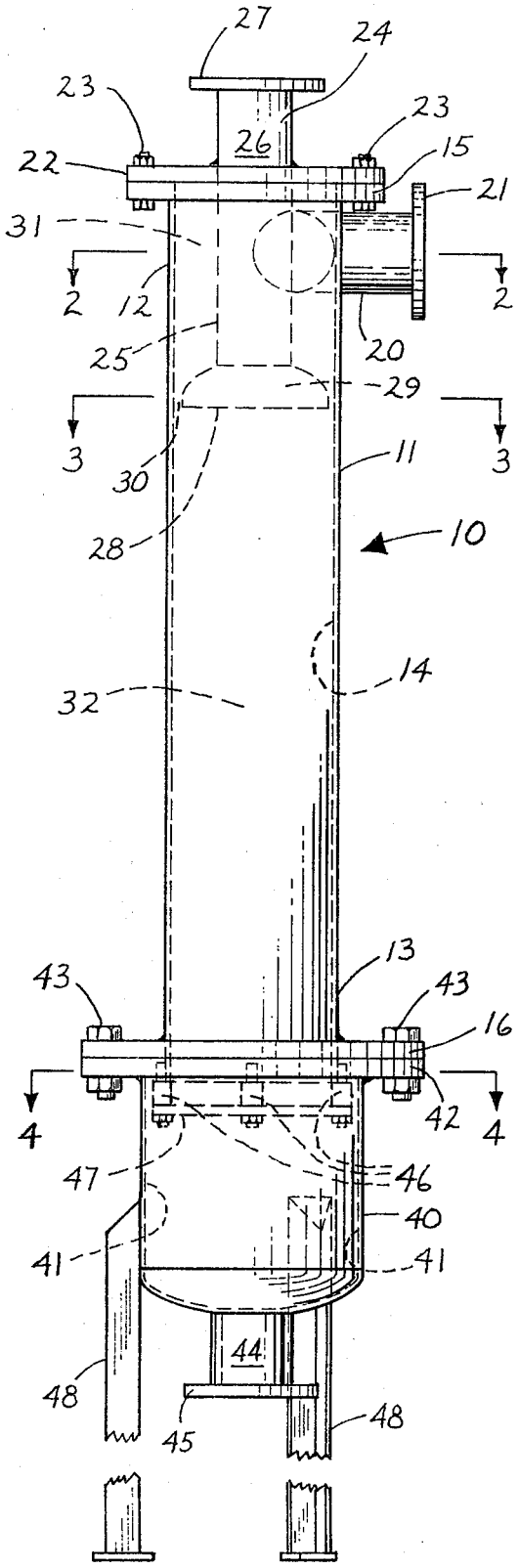
FIG. 1 is a side elevation of the apparatus of the present invention.

Referring in greater detail to the drawings, the apparatus for removing particles from fluid of the first form of the present invention is generally indicated by numeral 10 in FIG. 1. The apparatus has a substantially cylindrical housing or casing 11 having an upper end portion 12 and lower end portion 13. The casing has a substantially cylindrical internal surface 14. The upper end portion of the casing mounts a laterally extending peripheral flange 15 and the lower end portion of the casing mounts a similar but somewhat larger diameter lower peripheral flange 16. The casing, as described, is of standardized construction of the type used in the manufacture of tanks such as that used to house liquified petroleum gas and the like.

Figure 2:
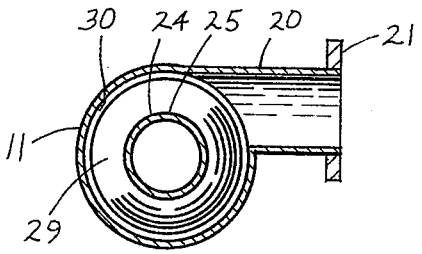
FIG. 2 is a transverse section taken on line 2—2 in FIG. 1.
Figure 3:
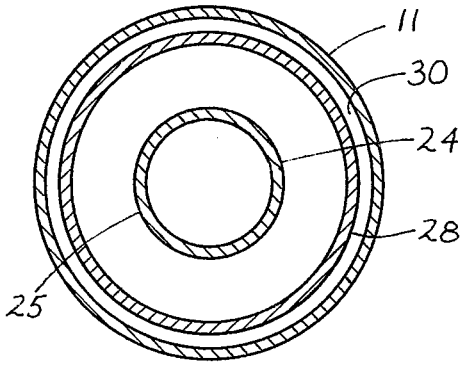
FIG. 3 is a somewhat enlarged transverse section taken on line 3—3 in FIG. 1.
Figure 4:
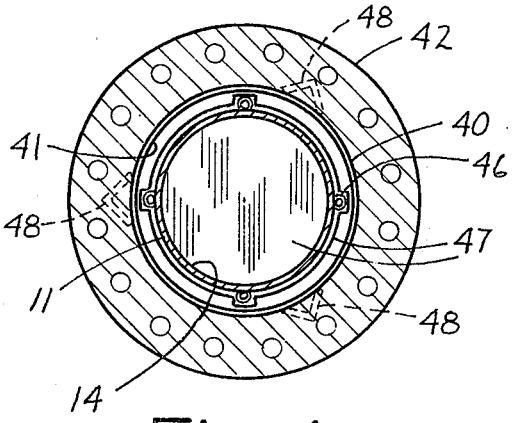
FIG. 4 is a transverse section taken on line 4—4 in FIG. 1.

An inlet conduit 20 is borne by the upper end portion 12 of the casing 11 so as to communicate with the interior thereof, as shown in FIG. 2, normal to and offset from the axis of the cylindrical casing in substantially tangential relation to the casing. The conduit has a mounting flange 21 remote from the casing for connection to a conduit, not shown, for the delivery of particle laden fluid, such as water containing sand or other particulate matter, through the inlet conduit into the casing. A sealing or end plate 22 is secured on the upper end portion of the casing by a plurality of nut-and-bolt assemblies 23 in fluid sealing relation thereto. It will be understood that a suitable gasket or similar sealing device, not shown, can be employed which permits the end plate readily to be removed by disassembly of the nut-and-bolt assemblies. However, it is the experience of the applicant that the apparatus requires little or no maintenance so that a suitable pipe dope or other sealing compound adequately achieves for such sealing engagement of the plate with the upper end portion of the casing. Such a substance permits rapid and reliable assembly and yet does permit the end plate to be removed if necessary.

Figure 5:
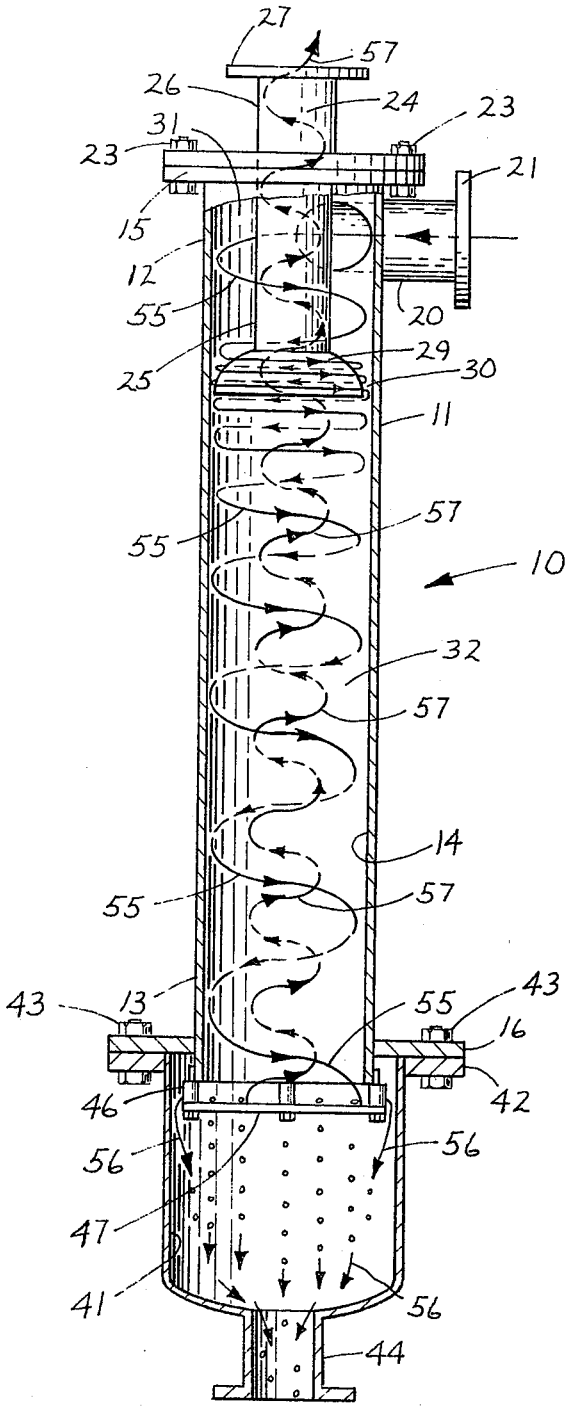
FIG. 5 is an axial section of the apparatus schematically illustrating with helical lines the fluid vortex produced in the apparatus.

A fluid outlet conduit 24 is secured in the end plate 22 in fluid tight relation extending substantially axially through the plate and into the casing 11. The conduit has an interior end portion 25 and an exterior end portion 26. A mounting flange 27, adapted for connection to a conduit, not shown, for transmission of fluid from the apparatus 10, is borne by the exterior end portion of the outlet conduit. A partition or constriction plate or baffle 28 is fastened on the interior end portion of the outlet conduit extending transversely of the casing and having a diameter a predetermined amount smaller than that of the internal surface 14 of the casing. The baffle has a substantially hemispherical surface 29 facing the end plate which slopes arcuately outwardly toward the interior surface of the casing and away from the end plate, as best shown in FIG. 5. The baffle defines an annular constriction passage 30 between itself and the internal surface 14 of the casing. The baffle partitions the interior of the casing into a surge chamber 31, between the baffle and the end plate, and a separation chamber 32, between the baffle and the lower end portion 13 of the casing. It will be noted that the interior area of the surge chamber is substantially greater than the cross sectional area of either the interior of the inlet conduit 20 or the constriction passage 30.

A particle housing 40 having an internal receptacle 41 and a peripheral mounting flange 42 is secured in fluid sealing relation on the lower end portion 13 of the casing 11 by a plurality of nut-and-bolt assemblies 43 extending in binding relation through the peripheral flange 16 of the casing and the mounting flange 42 of the particle housing. As previously described, a suitable gasket or sealing compound can be employed between the engaged flanges. A particle discharge conduit 44 is secured in fluid transmitting relation on the particle housing and has a mounting flange 45 at the remote end thereof for attachment to a conduit, not shown, adapted for transmission of particulate matter from the apparatus 10. As can best be seen in FIG. 5, the particle housing 40 is of larger diameter than the casing and is fitted about the lower end portion 13 thereof. A plurality of extensions 46 are mounted on the lower end portion of the casing extending endwardly into the receptacle defined by the particle housing. An end plate 47 is fastened on the extensions. The end plate extends transversely of the receptacle in spaced relation to the casing. The end plate has a diameter somewhat smaller than that of the receptacle. Although, of course, the apparatus can be mounted in a variety of configurations, the apparatus is shown in FIG. 1 mounted in an upright attitude on three supports 48.

For descriptive convenience, FIG. 5 schematically illustrates the path of fluid travel within the casing 11. Descending arrows 55 indicate the path traveled by an influx layer of fluid. This influx layer is caused by the offset communication of the fluid inlet conduit 20 with the surge chamber 31 to form a swirling fluid vortex within the surge chamber 31 and to pass therefrom through the constriction passage 30 and into the separation chamber 32 along a substantially helical path of travel. Arrows 56 represent the path traveled by fluid having a very high concentration of particulate matter being thrown centrifically from the influx layer in the casing into the particle receptacle 41. Ascending arrows 57 indicate the substantially helical path of travel of fluid having an extremely low concentration of particulate matter rising centrally of the casing and into the fluid outlet conduit 24.

DESCRIPTION OF THE SECOND EMBODIMENT

The apparatus of the second form of the present invention is generally indicated by the numeral 110 in FIG. 6. Apparatus 110 bears substantial similarity to apparatus 10 of the first form of the invention, but departs therefrom in certain respects to which reference will be made. Apparatus 110 has a casing 111 composed of an upper spheroidal or ellipsoidal portion 112, having an internal concave surface 113, and an integral lower cylindrical portion 114. The spheroidal and cylindrical portions are united weldably secured in axial alignment. The cylindrical portion has an internal surface 115 which communicates with the internal surface of the spheroidal portion, as best shown in FIG. 6. The cylindrical portion has a remote end 116.

A fluid inlet conduit 120 is mounted on the spheroidal portion 112 of the apparatus 110 and adapted to transmit particle laden fluid from a source connected thereto to the interior of the spheroidal portion so as to establish an influx layer within the spheroidal portion in the form of a fluid vortex, as described with respect to apparatus 10. The conduit has a remote mounting flange 121 adapted for connection to a source of particle laden fluid, not shown. An internally screw-threaded sleeve 122 is secured, as by welding, on the spheroidal portion of the casing in substantially axial alignment therewith. A fluid outlet conduit 124, having an interior end portion 125 and an externally screw-threaded portion 126, is screw-threadably mounted in the sleeve 122 extending into the casing, as shown in FIG. 6, for endward screw-threaded adjustment. A mounting flange 127 is screw-threadably secured on the externally screw-threaded portion of the conduit and adapted for connection to a suitable conduit, not shown, for transmission of fluid from the apparatus. A partition or constriction plate or baffle 128 is secured on the interior end portion of the conduit extending substantially transversely of the casing and having a substantially hemispherical convex outer surface 129 disposed in the direction of the remote end 116 and facing the surface 113. As can best be seen in FIG. 6, the baffle has a diameter somewhat larger than that of the lower cylindrical portion 114 of the apparatus and defines a constriction passage 130 between the hemispherical surface and the internal surfaces 113 and 115 of adjustable area as will subsequently be described in greater detail. The baffle partitions the interior of the apparatus into a surge chamber 131, housed within the spheroidal portion, and a separation chamber 132, housed within the cylindrical portion of the casing.

A spheroidal particle housing 140 is secured, as by welding, on the remote end 116 of the casing 111, as shown in FIG. 6. The housing defines an internal receptacle 141 adapted to receive particulate matter from the remote end of the casing. A particle discharge conduit 144 is connected to the particle housing and has a mounting flange 145 at the lower end thereof for attachment to another conduit, not shown, to transport particulate matter from the apparatus. A plurality of extensions 146 are fastened on the remote end of the casing extending endwardly therefrom into the receptacle of the particle housing. An end plate 147 is mounted on the extensions in spaced relation to the remote end and substantially normal to the casing.

DESCRIPTION OF THE THIRD EMBODIMENT

The apparatus of the third form of the present invention is generally indicated by the numeral 210 in FIG. 8. Apparatus 210 bears substantial structural similarity to the apparatus 10 and 110 previously described. Apparatus 210 has a substantially cylindrical casing 211 having an upper end portion 212 and a lower end portion 213. The casing has an upper cylindrical internal surface 214 of predetermined diameter, an intermediate, coaxial, tapered internal surface 215 adjoining surface 214 and sloping therefrom and a lower cylindrical internal surface 216 of reduced diameter adjoining the surface 215 and extending the remainder of the length of the casing, as shown in FIG. 8. An upper peripheral flange 217 is mounted on the upper end portion of the casing and a lower peripheral flange 218 is mounted on the lower end portion of the casing.

An inlet conduit 220 is mounted on the upper end portion 212 of the casing 211 in communication with the interior thereof, as shown in FIG. 9 and previously described with respect to apparatus 10 and 110. The conduit has a remote mounting flange 221 adapted for connection to a source of particle laden fluid under pressure, not shown. A sealing or end plate 222 is mounted in facing engagement with the upper peripheral flange 217 of the casing and retained in fluid tight sealing relation by a plurality of nut-and-bolt assemblies 223 extending through the peripheral flange and the end plate.

An internally screw-threaded sleeve 227 is secured, as by welding, on the end plate 222 in axial alignment with the casing 211. A fluid outlet conduit 228, having an interior end portion 229 and an externally screw-threaded portion 230, is screw-threadably mounted in the sleeve 227 in axial alignment with the casing for endward adjustment in the sleeve. A mounting flange 231 is screw-threadably secured on the externally screw-threaded portion of the outlet conduit and is adapted for connection to a conduit, not shown, adapted to transport fluid from the apparatus. A partition, constriction plate or baffle 232 is secured on the interior end portion of the outlet conduit extending transversely of the interior of the casing concentrically of the tapered internal surface 215 of the casing, as shown in FIG. 8. The baffle has a substantially hemispherical surface 233 facing toward the end plate and is of a diameter approximately equal to that of the lower cylindrical internal surface 216 of the casing. Thus, the baffle and tapered internal surface define a constriction passage 234 therebetween of adjustable area as will subsequently be described in greater detail. The baffle, extending transversely of the interior of the casing, partitions the interior thereof into a surge chamber 235, between the end plate 222 and the baffle 232, and a separation chamber 236 between the baffle and the lower end portion 213 of the casing.

A particle housing 240, substantially identical to particle housing 40 of apparatus 10 and having a receptacle 241 and a peripheral mounting flange 242, is mounted on the lower end portion 213 of the casing 211 with the mounting flange in facing engagement with the lower peripheral flange 218 and retained in position by suitable nut-and-bolt assemblies 243. A particle discharge conduit 244 is mounted on the housing in fluid tight engagement therewith and has a remote mounting flange 245 adapted for connection to a conduit, not shown, as in the other forms of the apparatus. As shown in FIG. 8, a plurality of extensions 246 are secured on the lower end portion 213 of the casing extending endwardly into the receptacle. An end plate 247 is fastened on the extensions and disposed transversely of the receptacle in spaced relation to the casing as in the first form of the apparatus 10.

OPERATION

The operation of the described embodiments of the subject invention are believed to be clearly apparent and are briefly summarized at this point. As previously noted, the apparatus 10, 110 and 210 operate in substantially the same manner to remove particulate matter from a particle laden carrier fluid. This operation can best be seen in FIG. 5 with respect to the apparatus 10 wherein arrows 55, 56 and 57 schematically illustrate the path of fluid flow through the apparatus which operates to separate such particles from the carrier fluid. While FIG. 5 shows apparatus 10, it is important to note that this operation occurs in virtually the identical manner in apparatus 110 and 210.

Particle laden fluid is admitted to the inlet conduits 20, 120 and 220 of each apparatus 10, 110 and 210 respectively under pressure and discharged therefrom into the surge chambers 31, 131 and 235 respectively tangentially thereto so as to create a swirling influx layer following a substantially helical path of travel within each apparatus hereafter referred to as a fluid vortex and shown in FIG. 5 by arrows 55. As has been recognized in the case of other separating devices, such a fluid vortex produces a centrifuging action which causes the particulate matter in the fluid to be thrown outwardly by centrifical force against the internal surfaces 14, 113 and 214 of each casing 11, 111 and 211 respectively. Thus, the initial surge of particle laden fluid into the surge chambers establishes the fluid vortex and initiates outward movememt of the particles in the fluid. Thereafter, the fluid is directed by the hemispherical surfaces 29, 129 and 233 of the baffles 28, 128 and 232 respectively toward the annular constriction passages 30, 130 and 234 thus rapidly constricting the influx layer of each fluid vortex against the internal surfaces of the casings. Such constriction rapidly accelerates the speed of helical rotation of the vortex to increase the centrifuging action of the fluid. This action rapidly increases outward movement of the particulate matter in the carrier fluid by directing it against the interior surfaces of the casing of each apparatus.

As indicated by arrows 55, subsequent to movement of each fluid vortex through its respective constriction passage 30, 130 and 234 respectively, the helical speed of rotation of the fluid gradually decelerates during movement downstream within the separation chambers 32, 132 and 236. The length of the separation chambers allows the particulate matter which has been thrown to the periphery of each fluid vortex gravitationally to settle out of the decelerating fluid vortex. It will be seen that the optimum length for the separation chambers is, in part, determined by the characteristics of the particulate matter to be removed from the carrier fluid.

The axial location of the outlet conduits 24, 124 and 228 contributes in establishing a return path of fluid flow within each of the separation chambers 32, 132 and 236 internally of the downstream fluid vortex toward the outlet conduits as indicated in FIG. 5 by ascending arrows 57. The position at which the path of fluid flow commences a reverse movement toward each of the outlet conduits is dependent upon the interoperation of several factors including the specific shape and volume of the separation chambers, the speed of rotation of the fluid vortices, the internal diameters of the outlet conduits, and the lengths of the separation chambers. In any event, such a reversal occurs at least by the time the fluid vortices contact the end plates 47, 147 and 247 respectively. Since the centrifuging action has directed the particulate matter outwardly and since the upstream path of fluid discharge is axially of the chamber, the fluid moving helically toward the outlet conduits has had virtually all of the particulate matter removed therefrom.

Simultaneously, the particulate matter gravitationally settling out of the fluid vortices or traveling with the vortices downwardly along the internal surfaces 14, 115 and 216 of the casings 11, 111 and 211 respectively reach the end plates 47, 147 and 247 and are directed outwardly between the plates and the casings and into the receptacles 41, 141 and 241 for immediate discharge through the particle discharge conduits 44, 144 and 244. It will be seen that the end plates, by extending transversely of their respective receptacles, operate to prevent any such particulate matter from re-entering the separation chambers thereby preventing the matter from being reintroduced to the fluid traveling upstream inwardly concentrically to the fluid vortices toward the fluid outlet conduits.

It has been discovered that reliable operation of the apparatus 10, 110 and 210 occurs when the area of their respective constriction passages 30, 130 and 234 range between 60 percent and 230 percent of the cross sectional area of the inlet conduits. Selection of the appropriate proportions depends upon the characteristics of the particulate matter to be separated from the carrier fluid as well as upon the specific size and shape of the internal dimensions of the apparatus. Generally, however, a relatively smaller area for the constriction passages will be employed where comparatively fine particles are to be separated from the carrier fluid. Conversely, a relatively larger area will be employed where relatively larger particles are to be separated from the carrier fluid. Correspondingly, there will be little or no pressure drop for fluid transmitted through the apparatus depending upon the specific size of the constriction passage employed.

It should also be noted that all forms of the apparatus, including the casings, baffles and particle housings therefor, can be manufactured from readily available standardized component parts and do not require expensive tooling. Such component parts are of a type used in the construction of fluid tanks intended to contain liquified gas under pressure. Additionally, it will be seen that the baffles and internal surfaces of the apparatus are not subject to the extremes of abrasive wearing associated with conventional separating devices since no internal cone structures are employed. Furthermore, such standardized component parts are of heavy-duty construction, as shown in the drawings, allowing them to take considerable wear without detracting from their operative effectiveness. Such surfaces can, of course, also be coated with protective substances.

As previously discussed, the apparatus 110 and 210 operate substantially identically to apparatus 10. However, apparatus 110 and 210 offer the additional operative advantage of being adjustable to vary the area of their respective constriction passages 130 and 234 thereby making these apparatus adjustable to handle particle laden carrier fluids of different characteristics. Such adjustment requires only removal of the conduits connected to the mounting flanges 127 and 231 of the fluid outlet conduits 124 and 228 respectively. Thereafter, these conduits are simply screw-threadably endwardly adjusted in their respective internally screw-threaded sleeves 122 and 227 to position the baffles 128 and 232 respectively in the desired positions relative to the internal surfaces 113 and 115 of apparatus 110 and internal surface 215 of apparatus 210. It will be seen that appropriate notation on the outlet conduits will permit precise adjustment of the baffles to define constriction passages of the precise desired cross sectional area for the particular particle laden fluid to be transmitted through the apparatus. Adjustment is thus accomplished without disassembly of the apparatus and requires only an absolute minimum of inoperative time for such adjustment.

Therefore, the apparatus of the present invention are operable effectively to remove particulate matter from carrier fluids transmitted therethrough while producing little or no fluid pressure drop, are adapted to be manufactured from standardized component parts without expensive tooling, require little or no maintenance over prolonged periods of time as a result of wearing and are adapted to be produced in forms permitting rapid adjustment for the processing of carrier fluids of different characteristics without disassembly.

Although the invention has been herein shown and described in what are conceived to be the most practical and preferred embodiments, it is recognized that departures may be made therefrom within the scope of the invention, which is not to be limited to the illustrative details disclosed.

Having described my invention, what I claim as new and desire to secure by Letters Patent is:

1. A cyclonic apparatus for removing particulate matter from fluid comprising:

A. a substantially spheroidal surge chamber having opposite open axial ends;

B. an internally screw-threaded sleeve mounted coaxially in one of the ends of said chamber;

C. an elongated cylindrical outlet conduit screw-threadably mounted in the sleeve coaxially of said chamber for axial adjustment with respect thereto and having an end extended through the chamber and through the open end of the chamber opposite to the sleeve, 1. the chamber presenting an axially disposed concave inner surface of revolution concentrically of the outlet conduit and in spaced relation thereto to define an annular opening therebetween;

D. an inlet conduit connected tangentially to the surge chamber to fill said chamber with fluid containing particulate matter and to swirl the same in said chamber about the outlet conduit;

E. a cylindrical casing connected to the surge chamber and axially extended therefrom concentrically of the outlet conduit defining an annular separation chamber therebetween;

F. a substantially hemispherical baffle mounted concentrically on the outlet conduit for axial adjustment therewith, said baffle presenting an axially disposed convex outer surface of revolution in facing and spaced juxtaposition to said concave surface of the chamber to define a passage therebetween leading to the separation chamber of a capacity adjustable by axial adjustment of the outlet conduit, 1. said convex and concave surfaces each having a radius normal to the axis of the surge chamber and a radius in a plane diametric to the surge chamber and the radius of the convex surface in both instances being less than the corresponding radius of the concave surface so that the defined constricted passage is arcuately downwardly and inwardly directed and progressively downwardly constricted to cause an accelerated swirling action through the passage to the separation chamber; and G. a particle chamber connected to the casing adapted to have particles settle therein as the fluid passes out the outlet conduit.

2. The apparatus of claim 1 in which the convex and concave surfaces are substantially tangential to a common plane normal to the axis of the chamber at said annular passage.

3. The apparatus of claim 1 in which the particle chamber is substantially spheroidal, the casing is connected axially to the particle chamber, and a circular plate is mounted on the end of the casing within the particle chamber in spaced relation to the casing to permit centrifugal passage of particles, therebetween.

* * * * *